United States Patent [19]

Berman et al.

[11] 3,993,282

[45] Nov. 23, 1976

[54] CONSTRUCTION FORM SUPPORT MEMBER

[75] Inventors: Herbert M. Berman; Ira Hooper, both of New York, N.Y.

[73] Assignee: Composite Construction Systems, Inc., New York, N.Y.

[22] Filed: Jan. 24, 1975

[21] Appl. No.: 543,785

Related U.S. Application Data

[62] Division of Ser. No. 313,488, Dec. 8, 1972, Pat. No. 3,900,182.

[52] U.S. Cl. ..... 249/24; 52/632; 248/354 R; 249/210

[51] Int. Cl.[2] ..... E04G 17/00; E04G 25/04

[58] Field of Search ..... 249/19, 24, 25, 28, 249/29, 30, 31, 50, 209, 219 R; 52/632; 248/354 R, 254 R; 105/498, 499, 500

[56] References Cited

UNITED STATES PATENTS

| | | | |
|---|---|---|---|
| 662,162 | 11/1900 | Balph | 249/24 |
| 1,084,236 | 1/1914 | Siderits et al. | 248/254 R X |
| 1,888,181 | 11/1932 | Riesbol | 249/50 X |
| 2,350,113 | 5/1944 | Hurley | 248/254 R |
| 2,386,161 | 10/1945 | Hawes | 248/354 R |
| 2,627,821 | 2/1953 | Sjogren | 105/499 |
| 2,806,436 | 9/1957 | Johnston | 105/500 X |
| 2,949,656 | 8/1960 | Pleitgen | 249/19 |
| 2,974,762 | 3/1961 | Hunnebeck | 52/632 |
| 3,045,786 | 7/1962 | Delarambelje | 52/632 |
| 3,054,486 | 9/1962 | Delarambelje | 52/632 |
| 3,090,329 | 5/1963 | Rolfe | 248/354 X |
| 3,124,223 | 3/1964 | Kisovec | 52/632 |
| 3,247,639 | 4/1966 | Delarambelje | 52/632 |
| 3,411,459 | 11/1968 | Hyatt | 105/499 |
| 3,721,200 | 3/1973 | Schmidt | 105/499 |

*Primary Examiner*—Richard B. Lazarus
*Assistant Examiner*—John S. Brown
*Attorney, Agent, or Firm*—Thomas R. Boland

[57] ABSTRACT

A reusable, longitudinally adjustable, readily removable form support member for supporting a concrete construction form in an array of structural members in a building construction. In one embodiment the form support member comprises a spanning member having laterally translatably support pin members secured in recesses in opposed ends of the spanning member for engaging openings in adjacent structural members. The support pins may be movable in a horizontal plane so as to permit their alignment with the structural openings where necessary. The support pin members include block means attached to the rear portions of the support pins, the block means cooperating with respective activating means to move the spanning member in a vertical plane so that an inside surface of the respective end parts of the spanning member contacts a surface of the block means and effect a friction bond which prevents longitudinal movement of the respective parts. Other embodiments for extending and retracting the support pins are also shown and described.

3 Claims, 5 Drawing Figures

CONSTRUCTION FORM SUPPORT MEMBER

This is a division of application Ser. No. 313,488 filed Dec. 8, 1972, now U.S. Pat. No. 3,900,182.

BACKGROUND OF THE INVENTION

This invention relates to general construction. More particularly, this invention relates to an improved system for the erection and stripping of concrete forms in building construction. Still more particularly, this invention relates to a form support structure utilizable in conjunction with the structural members for use in construction systems.

In the art of building construction, a number of methods and apparatuses are known for constructing concrete floors, decks, or ceilings in low-rise or high-rise buildings. It is an aim in these arts to fabricate and ship materials and forms for such construction at comparatively low costs and to reuse the forms readily and simply in erected framework. In such construction, the frameworks and forms previously utilized have varied from relatively simple to quite complex. In general, each particular building project requires an independent determination of the forms, framework, and structural elements which must be employed. However, it is in the interest of the builder and the consumer to utilize forms or adaptable forms capable of readily being erected at the building site and reused. An excellant example of an available forming structure which has been adapted for forming concrete is conventional plywood sheets.

In a certain building construction, in which the flooring slabs in the building construction are integrated with the structural supporting network to provide the required structural strength, a plurality of girders is used to form a structural grid work with a plurality of structural beams or joists. The girders and beams or joists are securely connected to become part of the building structure and are installed at the building site with the use of standard structural units.

In connection with such structural gridwork of girders and beams or joists, plywood of standard dimensions, suitably suspended between the beams and joists, has proved satisfactory in providing a form for the pouring of concrete to form slabs integrated with the girder and joist construction. In such arrangements, it is a continuing problem to provide means for suspending the plywood formwork for its intended purpose while yet being readily removable. Thus, a number of methods directed to a solution of this problem have been devised. For example, the U.S. Pat. No. to Dragunas, No. 3,121,933, describes the use of supporting clips secured to the top flanges of the beam members so that the plywood panels may be placed between the flanges of the beam members and conveniently rest upon the projections provided by the secured clips. After the concrete of the floor slabs above the beam members and the plywood panels has hardened, the clips are fractured and the plywood forms are removed. After being removed, the plywood forms may be reused.

The patent to Klausner, No. 3,307,304, is another example of a frangible clip arrangement for installing and holding concrete forms relative to steel beams and open-web steel joists preparatory to the pouring of concrete so that such forms are easily stripped from the beams and joists following the curing of the concrete.

However, among the difficulties with the use of frangible clip-type members supporting the form is that a plurality of clip sizes is required, and that the clip-type structural elements are not reusable. Accordingly, it is a principal object of this invention to provide a readily-adjustable, strong form support member that can be reused many times. Such form support members are readily adjustable to be used in installations where the spacing between the supporting beams or joists is irregular or in separate installations having differing beams or joists spacing. It is another constraint on the development of such a support member that it be readily positioned for use and securely and safely retained in position during use. In addition, such forms must be readily removed from the installation after the concrete has cured.

Moreover, it is desired to support the concrete plywood form continuously across its full width to reduce its deflection and also to eliminate the possibility of forms slipping off their bearings as could occur where clips are used.

It is prime objective of this invention to provide a reusable form support member capable of being adjustably mounted between beams or joists in building constructions.

It is an additional object of this invention to provide a form support member of the type described which is capable of being readily secured and released from the construction system.

It is yet another object of this invention to provide a form support member having interchangeable telescoping parts.

It is still an additional object of this invention to provide a form support member of the type which provides axially-opposed extensible pin members to be received in beams or joists in a structural configuration to provide support for a concrete form.

It is an additional object of this invention to provide a form support member of the type generally described which is longitudinally adjustable so that the form support member may be utilized in various geometrical configurations and between beams or joists at varied distances.

It is a further object of this invention to provide a form support member of the type which provides axially-opposed, laterally adjustable pin members.

These and other objects and purposes of this invention will become apparent from a detailed description of the invention followinng hereafter, taken in conjunction with the accompanying drawings.

BRIEF SUMMARY OF THE INVENTION

Directed to overcoming the shortcomings and problems in the prior art, this invention comprises a form support member to be secured between the beams and joists in a structural configuration. The form support member, comprises a spanning member having suitable recesses in distal end portions thereof and support pin members which are secured in such recesses so that they are axially opposed in the end portions of the spanning member, to be received in openings or recesses in adjacent beams or joists spanning girders in a building construction. A preferred construction comprises pre-cast concrete joists having openings defined therein for receiving the opposed pins of the support member. The support member is provided with means for effecting a bond, usually a friction bond, between the spanning member and the support pin members so that when located in position between adjacent beams or joists longitudinal movement of the respective parts is prevented. This is accomplished by providing activating means which cooperate with a block portion of the respective support pin members to move the spanning member in a vertical plane so that a surface of the spanning member contacts a surface of the block portions to effect the friction bond. The pins may be movable in a horizontal plane so as to permit their alignment with the openings where necessary. Other embodiments are shown hereinafter.

BRIEF DESCRIPTION OF THE DRAWINGS

In the drawings:

FIG. 3 is a view taken along line 3—3 of FIG. 2;

DETAILED DESCRIPTION OF THE PREFERRED EMBODIMENTS

Figure 1:
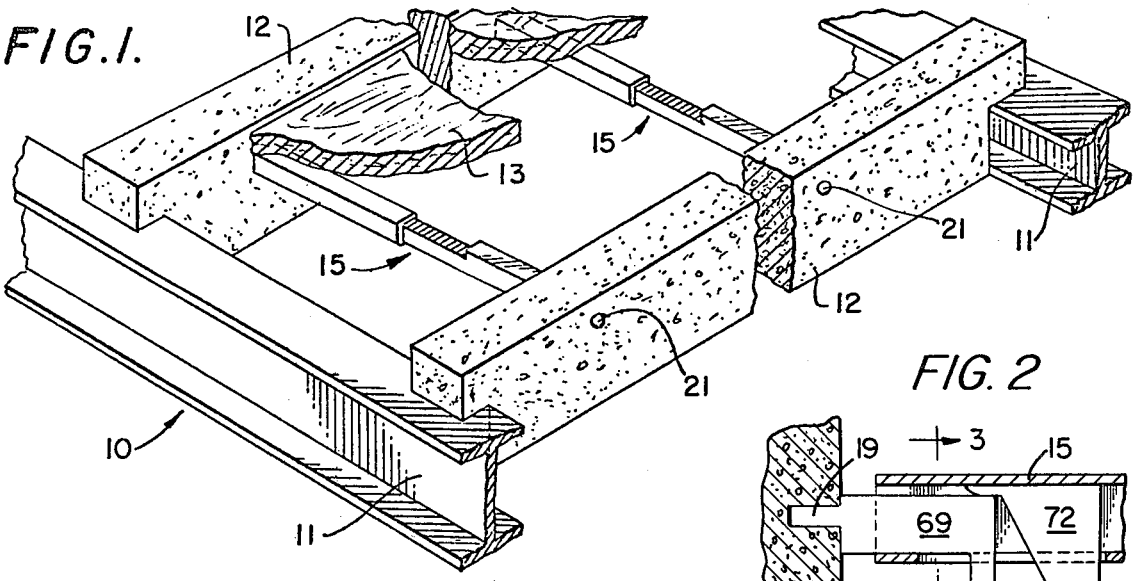
FIG. 1 is a perspective view of a representative section of the building construction showing structural members and support members positioned to receive a concrete construction form there-upon prior to pouring the concrete slab thereover.

In FIG. 1, a representative portion of a composite building construction is designated generally by the reference numeral 10. The construction 10 comprises a plurality of structural members 11 spanning suitable structural members and secured to a base support (not shown) in a manner well known to the art. The members 11 may be made of any conventional structural element, but are shown in FIG. 1, for purposes of illustration, as I-beams.

A plurality of structural members, such as joists 12, is secured to the members 11 and traverse the structure at spaced intervals in a position substantially transverse to the members 11. Since it is desired to place a cementitious material, such as concrete, in the space between and over the structural members to form a slab, it is desired to provide a concrete supporting or molding construction form, for example, a plywood sheet, shown at reference numeral 13, for supporting the weight of the concrete between the structural members.

In order to support the concrete construction form 13 to retain the wet cementitious mixture above the structure of FIG. 1, a plurality of form support members according to the invention, designated generally by the reference numeral 15, is removably secured to the structural members 12. While the form support members 15 act primarily to support the weight of the concrete construction form 13 and the concrete above, they also act as bracing bars between the members 12 to retain the members 12 in a secure position during the placing and curing of the concrete.

Figure 2:
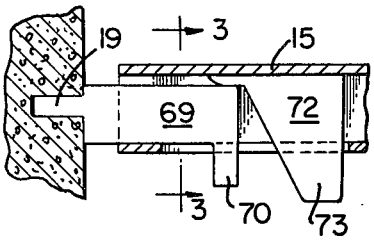
FIG. 2 is a view of an embodiment showing a laterally-movable wedge secured adjacent to a laterally-movable block and pin for securing the block therein.

FIG. 2A illustrates an embodiment of the invention wherein the block 69 includes a knock lug 70 protruding through a lower portion of the end portion of the support member 15 and a laterally translatable wedge 72 having a knock portion 73 protruding therebelow so that the pin 19 may be driven by a hammer into position and the wedge 72 thereafter driven against the pin to secure it against movement. After the concrete has hardened and it is desired to remove the support member 15, the wedge is removed therefrom and the pins are removed from the openings in the structural members.

Figure 4:
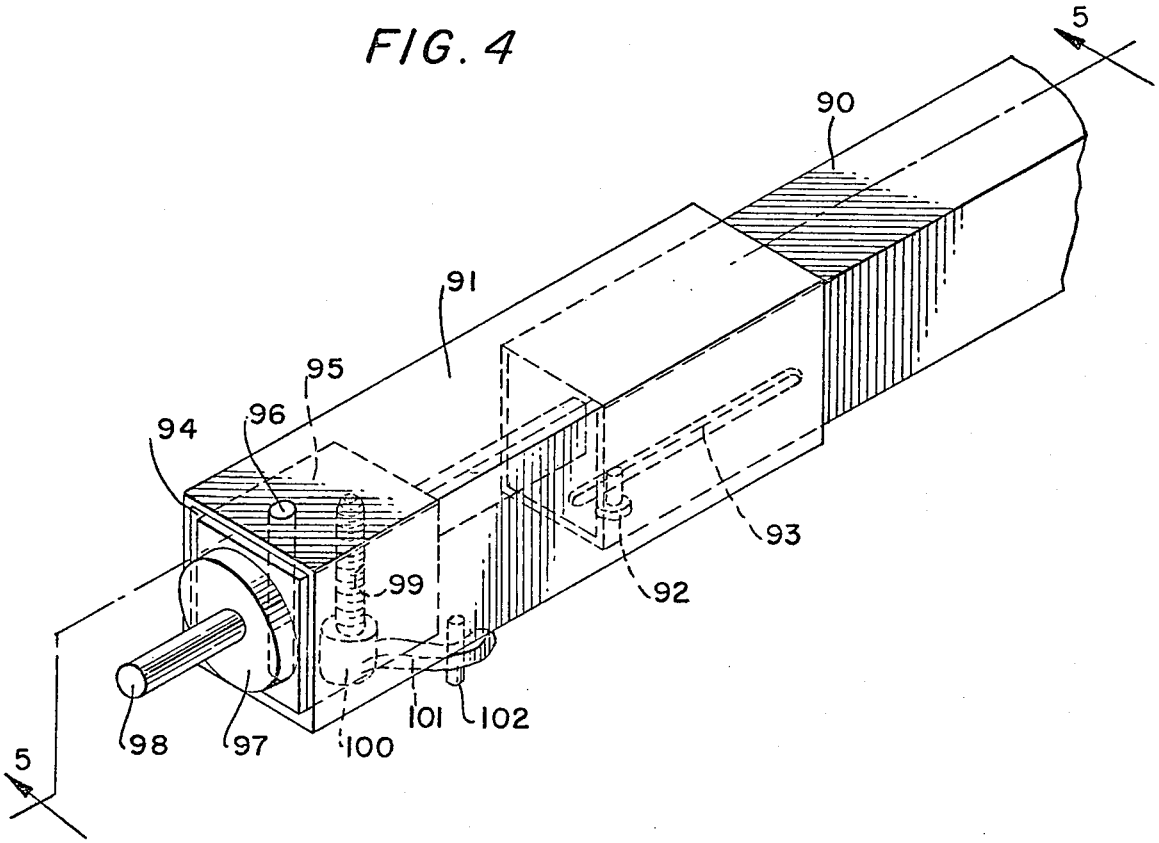
FIG. 4 is a fragmentary, perspective view of a form support member showing various hidden parts in dotted lines.

In the form support member illustrated in FIG. 4, an end portion of a tubular member 90 is arranged inside the proximal end of a telescoping part 91 and slideably retained therein by a pin member 92 which is secured in a slot 93 provided in the bottom segments of the reciprocating parts. The pin member 92 may be removable, such as a screw, to permit a convenient interchange of the telescoping parts and tubular member. The distal end of the telescoping part 91 defines a recess 94 to receive a block 95 in a slightly spaced relationship permitting lateral and vertical movement of the block therein. A guide pin 96 is fixedly secured to the inside surface of the telescoping part 91 and extends through a recess in the block 95 so that the block is vertically and laterally translatable but restrained against longitudinal movement within the telescoping part 91. A bracing member or shoulder 97 is secured to an outer end of the block 95 and a support pin 98 is affixed to the shoulder 97. A second, internally threaded, recess in the block 95 mates with a threaded member 99 having a head portion 100 at a bottom end thereof. The head portions extends through an aperture in the bottom portion of the telescoping part 91 and supports an actuating member such as a handle 101 which is fixedly attached thereto. A stop pin 102 is secured to the bottom outside surface of a telescoping part 91 and restricts the angular movement in either direction of the actuating member 101. Counterclockwise rotation of the actuating member causes retraction of the threaded member 99 into the recess in the block 95 whereas clockwise rotation of the actuating member causes the distal end of the threaded member to protrude from the top portion of the block and bear against the top inside surface of the telescoping part 91, moving it upward relative to the block.

Figure 5:
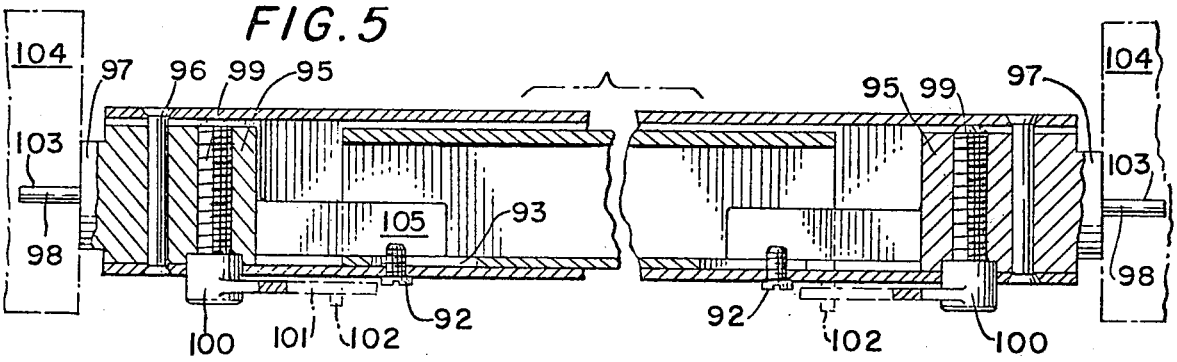
FIG. 5 is a vertical, longitudinal section, with a center part broken away, substantially on a line 10—10 of FIG. 9.

The operation of this embodiment is best understood with reference to FIG. 5 in which the form support member is shown in its secured position. This placement is achieved by positioning the support pins 98 in register with openings 103 in concrete joists 104 (shown in phantom) and outwardly telescoping the members 91 until the pins 98 are firmly set in the openings 103. The actuating members 101 are rotated so that the distal ends of the threaded members 99 protrude from the block and bear against the top inside surfaces of the telescoping members 91 forcing them upward. The blocks themselves are secured within the ends of the telescoping members 91 and are capable of slight downward movement therein when the threaded members 99 bear against the telescoping members 91. Restraining bars 105 are affixed to the rear portions of the blocks and project into the ends of the tubular member 90 to restrain the tubular member against vertical movement when the telescoping parts 91 are moved upward. Thus, when the telescoping parts are elevated, the bottom inside surfaces thereof come in frictional contact with the bottom end portions of the tubular member 90 and prevent inadvertent retraction of the support member before the forms have been laid on top and the concrete placed thereon and hardened. Of course, it should be understood that in another form, such inadvertent retraction may be prevented by providing a plurality of serrations in a mating relationship on the opposed inner and outer bottom surfaces in the end portions of the telescoping members and tubular member. After the concrete has hardened, the form supports may be easily removed from the construction by rotating the actuating member 101 counterclockwise so that the end of the threaded member 99 is retracted in the recess in the block 95. This allows the telescoping parts to move downward under gravity and away from contact with the forms which they previously supported. The forms will generally stick to the concrete, but they may be easily stripped therefrom after the support members are removed. This removal of the support members is accomplished by simply sliding the telescoping parts 91 into the tubular member 90 so that the support pins 98 are retracted from the openings 103 in the joists 104.

The invention may be embodied in other specific forms without departing from the spirit or the essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A form support member for supporting a concrete molding form relative to beams and joists in a building construction comprising, a spanning member having two distal end portions, each of said end portions being at least recessed to define an opening therein, a support pin member secured in each of said openings and being longitudinally translatable therein between a withdrawn position and an outwardly extending position wherein a pin portion of said support pin member is received in an opening of an adjacent joist and, activating means cooperating with said spanning member and each of said support pin members to provide vertical movement of the spanning member, relative to said support pin members, substantially along the entire length of said spanning member, between a contacting, supporting relationship with a molding form, and a retracted relationship with said molding form, said vertical movement to a contacting relationship effecting a frictional bond between said spanning member and said support pin members so as to secure the pin members against longitudinal movement, said vertical movement to a retracted relationship permitting easy withdrawal of the pin members from said openings and removal of the form support member.

2. A form support member according to claim 1 wherein the rear portion of each said support pin member is a block member, the block member being maintained within said recess in the distal end portions of said spanning member.

3. A form support member according to claim 2 wherein each said block portion is movable in a horizontal plane within said end portion to facilitate alignment of said pin members in said openings.

* * * * *

UNITED STATES PATENT OFFICE

CERTIFICATE OF CORRECTION

Patent No. 3,993,282 Dated November 23, 1976

Inventor(s) Herbert M. Berman; Ira Hooper

It is certified that error appears in the above-identified patent and that said Letters Patent are hereby corrected as shown below:

Column 2, line 49, "followinng" should read --following--;

Column 3, line 64, "2A" should read -- 2 --;

The following Figure should be inserted in the drawings:

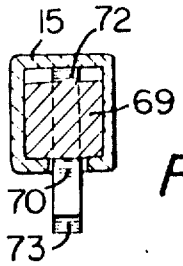

FIG. 3

Signed and Sealed this

Nineteenth Day of April 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,993,282 Dated November 23, 1976

Inventor(s) Herbert M. Berman; Ira Hooper

It is certified that error appears in the above-identified patent and that said Letters Patent are hereby corrected as shown below:

Column 3, line 28, "10--10" should read -- 5--5 --;

Column 3, line 29, "FIG. 9" should read -- FIG. 4 --;

Signed and Sealed this

Fourteenth Day of June 1977

[SEAL]

*Attest:*

RUTH C. MASON
*Attesting Officer*

C. MARSHALL DANN
*Commissioner of Patents and Trademarks*